United States Patent [19]

Lampson

[11] 4,170,309

[45] Oct. 9, 1979

[54] COUNTERBALANCED TOWER CRANE

[75] Inventor: Neil F. Lampson, Kennewick, Wash.

[73] Assignee: Riggers Manufacturing Company, Spokane, Wash.

[21] Appl. No.: 877,816

[22] Filed: Feb. 14, 1978

[51] Int. Cl.[2] ..... B66C 23/72

[52] U.S. Cl. ..... 212/48; 212/144; 212/49; 212/46 R

[58] Field of Search ..... 212/28, 46 R, 46 A, 212/47–48, 57, 58 R, 59 R, 61, 64–65, 69, 8, 144; 214/142

[56] References Cited

U.S. PATENT DOCUMENTS

| | | | |
|---|---|---|---|
| 3,777,900 | 12/1973 | Brewer | 212/58 R |
| 3,794,184 | 2/1974 | Higgins | 212/46 A |
| 3,836,010 | 9/1974 | Lampson | 212/49 |
| 3,842,984 | 10/1974 | Brown | 212/49 |
| 3,868,022 | 2/1975 | Greenlay et al. | 212/48 X |
| 3,921,815 | 11/1975 | Brown et al. | 212/48 X |
| 3,930,583 | 1/1976 | Jouffray | 212/49 |
| 3,955,684 | 5/1976 | Novotny | 212/48 |
| 4,103,783 | 8/1978 | Beduhn et al. | 212/48 |

OTHER PUBLICATIONS

American Hoist and Derrick Co., Sky Horse, 900 Series.

*Primary Examiner*—Albert J. Makay
*Assistant Examiner*—R. B. Johnson
*Attorney, Agent, or Firm*—Wells, St. John & Roberts

[57] ABSTRACT

A vertical tower and pivoted upper boom are counterbalanced by a mobile counterweight member mounted on a self-propelled earthborn unit spaced a substantial distance from the tower in diametric opposition to the boom. The tower, which is pivotable about a vertical pivot axis, is connected to the counterweight by a first horizontal rigid spreader link and by a second diagonal rigid spreader link. The two links are respectively connected to the lower and upper ends of the tower. In this manner, rotational torque is transmitted directly to both the lower and upper ends of the tower. Both the tower and the boom can therefore be turned about the vertical pivot axis by operation of the self-propelled counterweight unit without the usual problems of having the tower "winding up" due to the rotational forces applied to it during turning of large loads.

10 Claims, 8 Drawing Figures

COUNTERBALANCED TOWER CRANE

BACKGROUND OF THE INVENTION

This disclosure relates to tower cranes of the type used for vertical lifts in building construction projects and similar applications. The load being lifted must in many instances also be pivoted about the vertical tower axis. In the usual tower crane, pivotal torque is applied to the tower base, and is transmitted upwardly through the tower and horizontally through the boom to the load suspended on a cable. High inertial forces are thereby encountered, which tend to "wind" the tower.

Tower cranes are typically mounted to a relatively short counterweight base, requiring heavy counterweight units to balance the load carried on the boom. To remain erect, the overturning moment exerted by the load must always be less than the counterbalance moment on the tower.

According to the present invention, a rigid interconnection to a remotely spaced counterweight is provided to the vertical tower not only at its lower end, but also at its upper end. Rotational turning forces are applied to both the upper and lower ends of the tower from a self-propelled mobile counterweight unit. The resulting triangular rigid framework connecting the tower and counterweight unit eliminates the torsional twisting forces which would otherwise be applied to the tower by a connection to the counterweight only at its lower end.

DESCRIPTION OF THE PREFERRED EMBODIMENT

Figure 1:
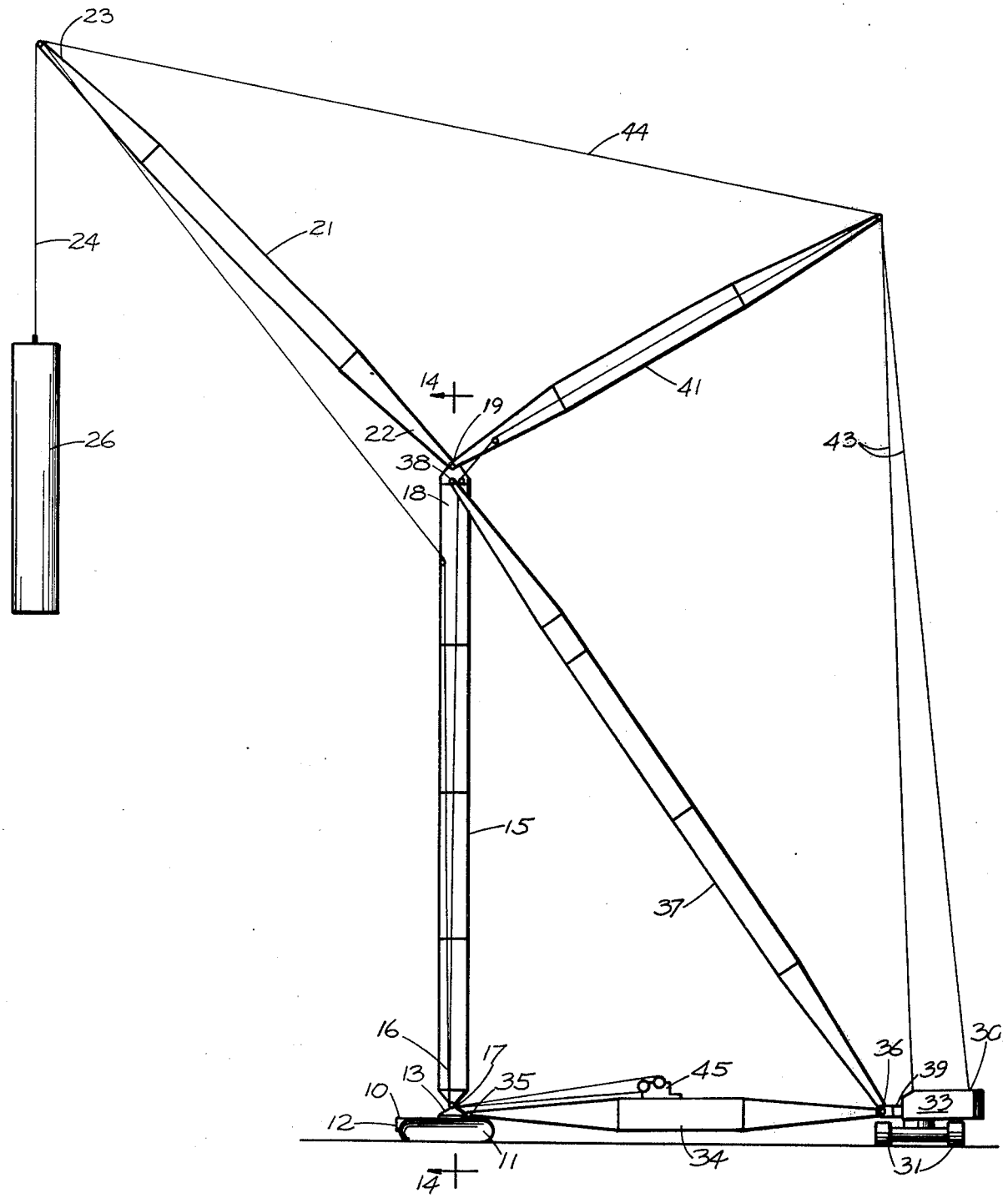
FIG. 1 is a side elevation view of the crane assembly.

The drawings illustrate a preferred form of the invention. In this arrangement the tower 15 is supported on a first self-propelled earthborn mobile unit shown generally at 10. The precise details of this mobile unit 10 are not necessary to an understanding of this invention, but it basically includes independently driven tracks 11 for steering and transport purposes. Tracks 11 are driven by power sources shown at 12, such as conventional internal combustion engines or electric motors. The mobile unit 10 supports an upwardly facing pivotal load platform 13 which is freely rotatable about a vertical pivot axis on the mobile unit 10 indicated by the line 14—14 in FIG. 1.

Tower 15 extends between a lower end 16 mounted to the mobile unit 10 and an upper end 18 that pivotally supports radial boom 21. The pivotal connection between the lower tower end 16 and the pivotal load platform 13 is indicated in the drawings by the numeral 17.

Boom 21 includes an inner end 22 pivoted to the upper end 18 of tower 15 about a transverse horizontal axis at 19. To reduce the turning moments at the upper end 18 of tower 15 the pivotal axis of boom 21 preferably intersects and is perpendicular to the vertical pivot axis 14—14 as illustrated.

The outer end 23 of boom 21 is provided with hoisting means in the form of a suspended wire rope 24. The outer end of wire rope 24 has means for carrying a load

26, such as a hook, sling or other suitable load engaging arrangement.

A second self-propelled earthborn mobile unit 30 is located a substantial radial distance from mobile unit 10. It includes independently powered tracks 31 driven by an independent power source. A counterweight member 33 within a suitable housing is mounted to the carriage supported by tracks 31 for pivotal movement about a vertical axis. Both the counterweight member 33 and the pivotal load platform 13 are freely pivotable about vertical support axes on their respective supporting carriages. This free pivotal movement permits tracks 31 to be turned relative to the counterweight member 33 for movement about a circumferential path centered on the vertical pivot axis 14—14 while rigidly connected to tower 15. It also allows the tracks 31 and 11 to alternately be aligned in a straight path or in transversely-spaced parallel paths for translational movement of the crane structure with or without a load.

Connecting the two mobile units 10, 30 are a first rigid spreader link 34 and a second rigid spreader link 37. The first rigid spreader link 34 is shown as a substantially horizontal boom structure with a pivotal connection 35 between spreader link 34 and the pivotal load platform 13. A similar pivotal connection 36 mounts the opposite end of link 34. Pivotal connection 36 is mounted to the counterweight member 33 by a horizontal pivotal connection 39 perpendicular to pivotal connections 35 and 36. The pivotal connections 35, 36 are horizontal and parallel to one another. Connections 35, 36 and 39 accommodate relative movement between mobile units 10, 30.

The second rigid spreader link 37 extends angularly upward from the second mobile unit 30 to the upper end 18 of tower 15. It has a pivotal connection shown at 28 between the link 37 and the upper end 18 of tower 15. A parallel pivotal connection common to the previously-described connection 36 joins its remaining end to the counterweight member 33.

The two rigid spreader links 34, 37 form a triangular structure in conjunction with the tower 15 to which they are joined. This provides a strong vertical structure behind tower 15 in diametric opposition to the load lifted by boom 31.

The crane is completed by a stay mast 41 which protrudes angularly from the upper end 18 of tower 15 to the side thereof opposite to boom 21. The staymast 41 overlies the spreader links 34, 37. The inner end of mast 41 has a pivotal connection to the upper end 18 of tower 15. This is along the axis common to boom 21 at 19. Its outer end supports guying cables 43 extending from the mast 41 to the counterweight member 33 and a guying cable assembly 44 schematically shown between mast 41 and the outer end 23 of boom 21. The guying cables 43, 44 operate in the normal fashion to control the angle of inclination of boom 21 relative to tower 15.

The hoisting means and guying means are controlled in the usual manner by a two drum hoist 45 shown mounted to the first rigid spreader link 34. It is believed that the operation of the crane in this respect is evident from the disclosure and is basically in accord with usual practice.

The novel aspect of this arrangement is the substantial separation of the counterweight from the vertical axis 14—14 of tower 15 and the structural arrangement of the rigid spreader links 34, 37, which imparts rotational torque or turning power to the tower 15 and boom 21. Contrary to many prior high load arrangements, the counterweight is not turned by applying turning power to the crane or tower structure itself. Rather, tower 15 and boom 21 are pivoted about axis 14—14 by operation of the second mobile unit 30 and tracks 31. However, since substantial torsional forces develop in a vertical tower 15 if the turning movement is applied only to its lower end, the preferred embodiment utilizes the second spreader link 37 to apply rotational torque directly to the upper end 18 of tower 15 at the same time that the same torque is being applied to its lower end 16 through the first link 34. Furthermore, to reduce the turning forces at the upper end 18, the inner end 22 of boom 21, the inner end of the stay mast 41, and the upper end of the second rigid spreader link 37 are preferably mounted to the tower 15 about closely spaced axes intersecting the vertical axis 14—14. This eliminates development of turning torques of any magnitude through the tower structure itself.

The disclosed arrangement permits the lifting of substantially greater loads by a tower crane constructed essentially from conventional crane structures. The counterweight member 33 can be a conventional crane housing including counterweight ballast, engines and winch assemblies. In such an arrangement, the second link 37 might be the conventional mast for the mobile frame including the housing serving as the counterweight member 33. This is particularly desirable since the spreader link 37 can be used to lift the tower 15 into position by swinging it about its pivotal connection 17 to the pivotal load platform 13. After erecting the tower 15, the mast can be joined to the upper end of the tower to serve as the second link 37 in the triangular connection between tower 15 and the two mobile units 10, 30.

Figure 2:
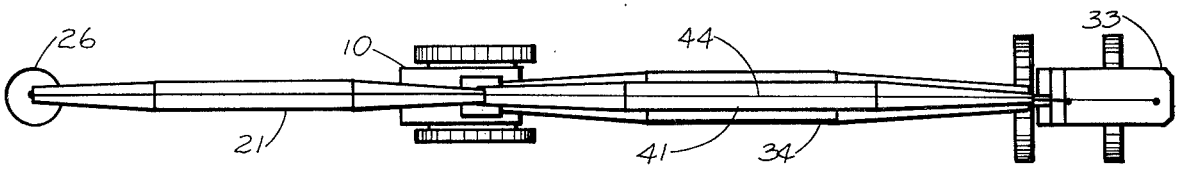
FIG. 2 is a top view.

FIGS. 3 through 8 schematically show one practical sequence by which the tower crane of FIGS. 1 and 2 might be erected.

Figure 3:
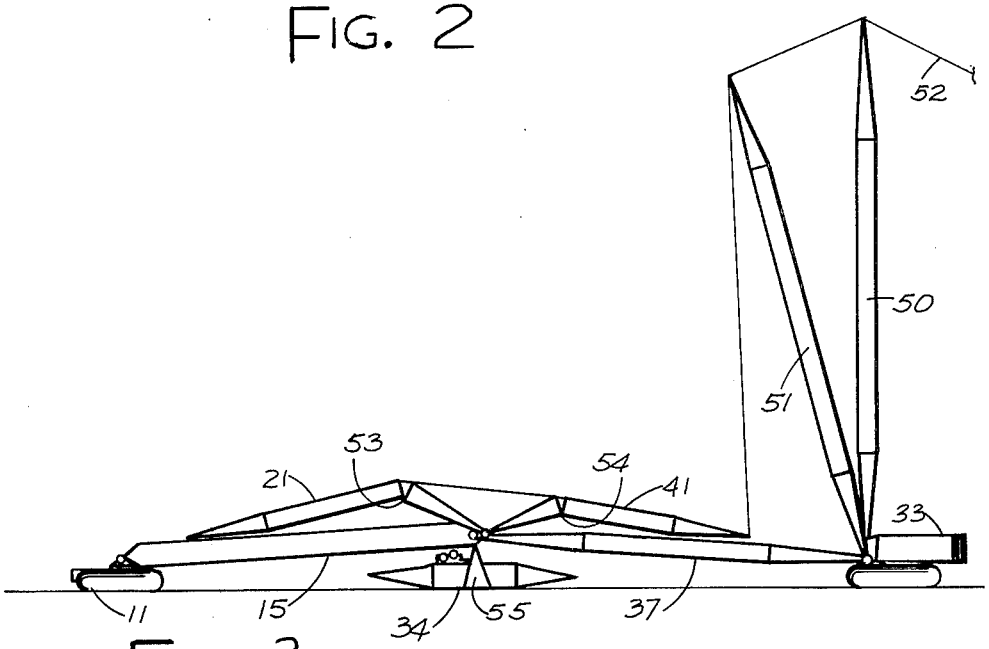
FIGS. 3 through 8 illustrate erection of the crane assembly.
Figure 4:
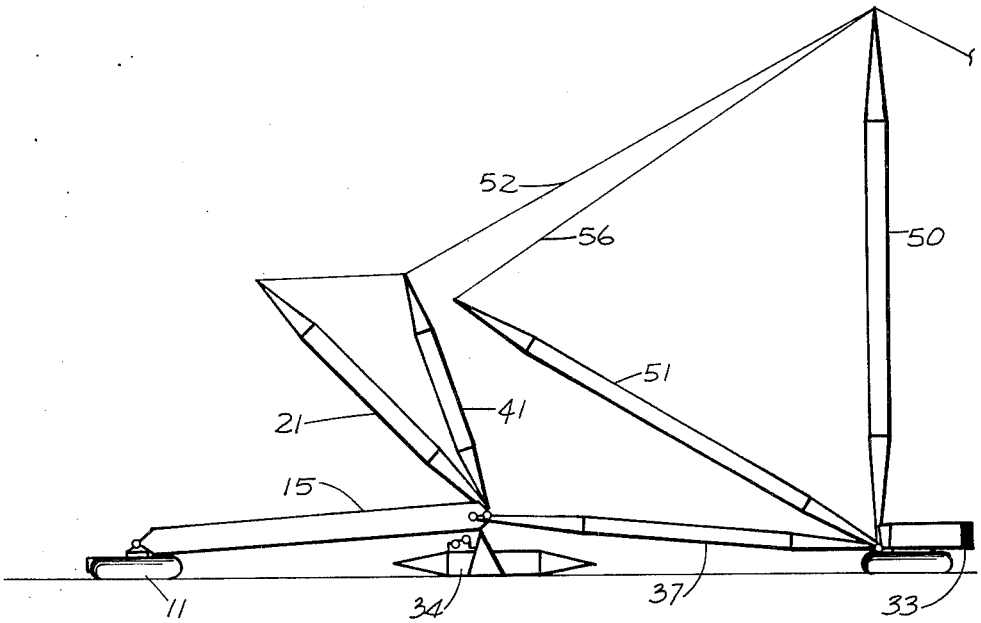

In FIG. 3, a conventional crane 33 is shown with a pair of pivotal booms 50, 51 supported by a stationary guy line 52 extending outward to a fixed anchor (not shown). The tower crane is in a disassembled horizontal arrangement, with the sections of boom 21 and stay mast 41 folded at 53, 54 respectively. The upper end of tower 15 overlaps link 34 and is supported by a temporary bracket 55 straddling link 34. Erection is started by connecting guying cable 44 between the outer ends of boom 21, stay mast 41 and boom 50.

As the cable 44 pivots boom 21 and mast 41 upward (FIG. 4), their folded sections are locked, and boom 51 becomes available for lifting of the tower itself. This is accomplished through a cable 56 (FIG. 5) leading to the upper end 18 of the tower.

Figure 6:
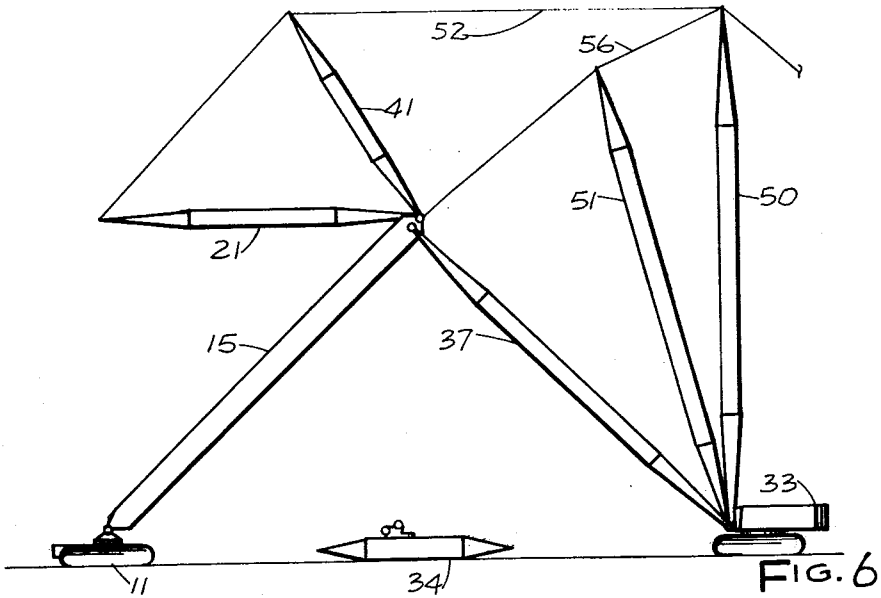
Figure 5:
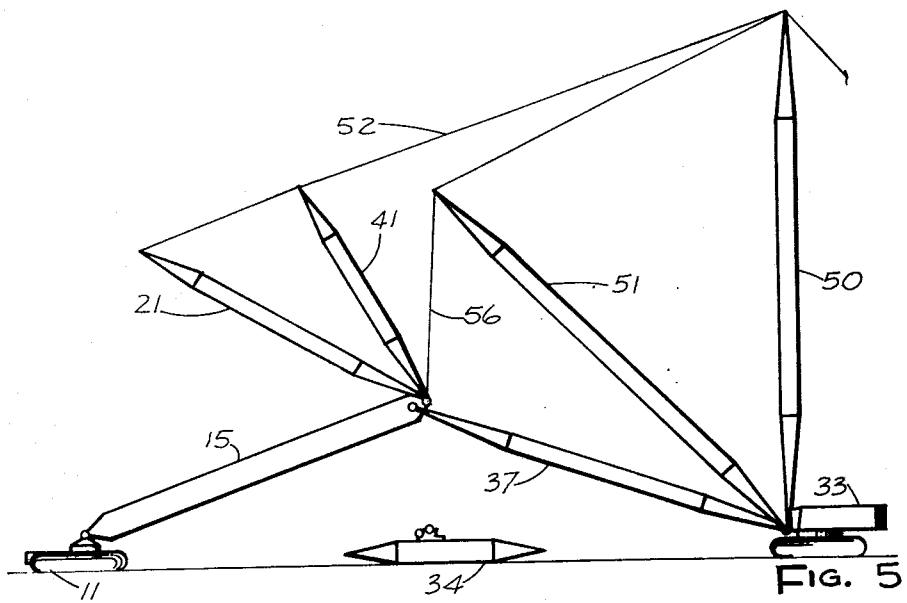
Figure 8:
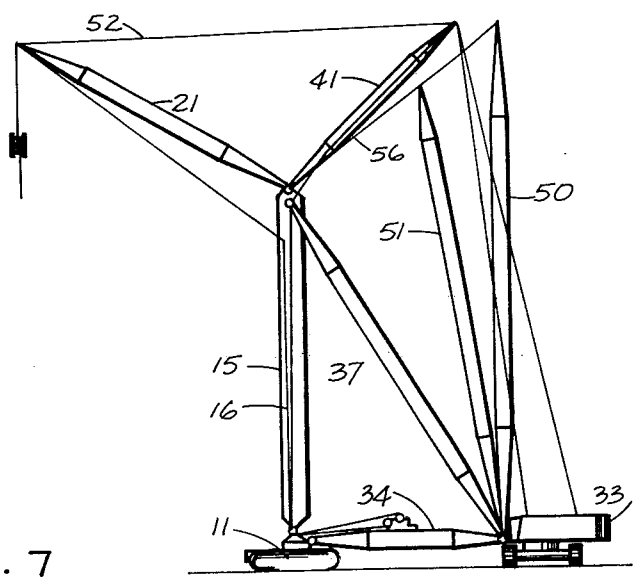
Figure 7:
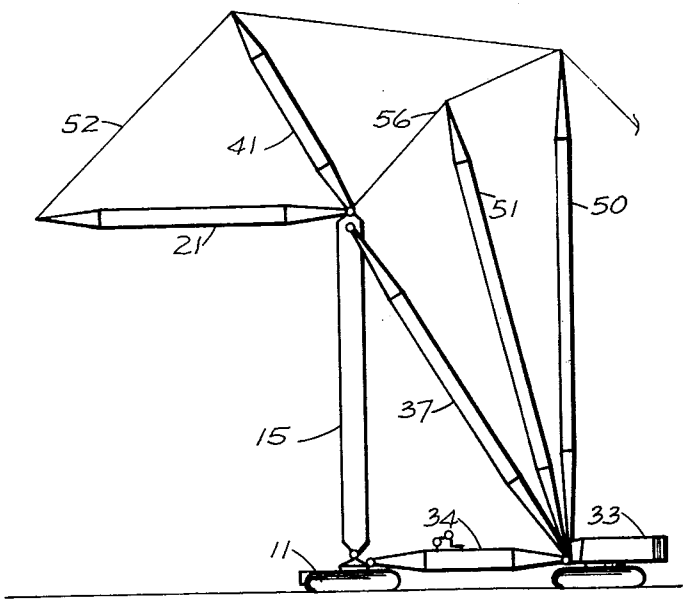

As the tower is lifted by the rigging, the two mobile units 10, 30 are powered toward one another and toward the now-detached spreader link 34. This progressive motion is shown in FIGS. 5 and 6. Erection is completed by lifting of link 34 in place, connecting it to units 10, 30 respectively (FIG. 7). FIG. 8 shows the completed tower crane, with booms 50, 51 being essentially idle until needed to dismantle the assembly.

Various modifications might be made without deviating from the basic concept of the structure disclosed herein. For this reason, the following claims are intended to define the bounds of the disclosed invention.

Having described my invention, I claim:

1. A counterbalanced tower crane comprising:

earthborn tower base means;

upright tower means having a lower end mounted to said tower base means for horizontal rotational movement about a vertical pivot axis;

boom means pivotally mounted to said tower means at an elevation above said tower base means for pivotal movement relative to said tower means about a horizontal pivot axis, said boom means being extended radially outward to one side of the vertical pivot axis of said tower means;

load hoisting means mounted to said boom means;

an earthborn mobile counterweight unit spaced a substantial distance radially from said tower base means in diametric opposition to said boom means with respect to said vertical pivot axis, said counterweight unit including a counterweight member supported on a mobile base;

power means mounted to said mobile counterweight unit and operably connected to the mobile base thereof for selectively moving the mobile counterweight unit in a circumferential path about said vertical pivot axis;

first rigid spreader link means operably connected to the lower end of said tower means and to said mobile counterweight unit for applying rotational torque to the lower end of said tower means about said vertical pivot axis in response to movement of the mobile counterweight unit along said circumferential path;

second rigid spreader link means operably connected to said tower means above its connection to said first rigid spreader link means and to said mobile counterweight unit for applying rotational torque to said tower means in conjunction with said first rigid spreader link means, said second rigid spreader link means overlying said first rigid spreader link means in a vertical rigid triangular structure completed by said tower means and located diametrically opposite the boom means;

and powered winching means operably connected to said load hoisting means.

2. A tower crane as set out in claim 1 wherein the first rigid spreader link means comprises a horizontal boom assembly pivotally connected at the ends thereof about parallel first and second horizontal axes on said tower means and said mobile counterweight unit, respectively;

said second rigid spreader link means comprising a boom assembly pivotally connected at one end to said mobile counterweight unit about said second horizontal axis and pivotally connected at its remaining end to said tower means about a third horizontal axis parallel to said first and second horizontal axes.

3. A tower crane as set out in claim 2 wherein each of said third axis and said horizontal pivot axis intersects the vertical axis between said tower base means and said tower means.

4. A tower crane as set out in claim 1 further comprising:

a stay mast mounted on said tower means; and guying means operably connected between said boom means, said stay mast, and said mobile counterweight unit, whereby the weight of the latter is applied in a counterbalancing manner relative to loads borne by said load hoisting means.

5. A tower crane as set out in claim 1 further comprising: a stay mast mounted on said tower means for pivotal movement about said horizontal pivot axis, said stay mast being extended radially outward from said tower means in diametric opposition to said boom means; and guying means operably connected between said boom means, said stay mast, and said mobile counterweight unit, whereby the weight of the latter is applied in a counterbalancing relation to loads borne by said load hoisting means.

6. A tower crane as set out in claim 5 wherein the first rigid spreader link means comprises a horizontal boom assembly pivotally connected at the ends thereof about parallel first and second horizontal axes on said tower means and said mobile counterweight unit, respectively;

said second rigid spreader link means comprising a boom assembly pivotally connected at one end to said mobile counterweight unit about said second horizontal axis and pivotally connected at its remaining end to said tower means about a third horizontal axis parallel to said first and second horizontal axes.

7. A tower crane as set out in claim 1 wherein each of said third axis and said horizontal pivot axis intersects the vertical axis between said tower base means and said tower means.

8. A counterbalanced tower crane, comprising:

a first self-propelled earthborn mobile unit;

a pivotal load platform mounted to said first mobile unit about a vertical pivot axis;

a vertical tower having a central vertical axis and upper and lower ends spaced along said central vertical axis, the lower end being mounted to said pivotal load platform with its central vertical axis coincident with the vertical pivot axis;

a boom pivotally mounted to the upper end of the vertical tower about a horizontal pivot axis intersecting said central vertical axis, said boom being extended radially outward to one side of said central vertical axis;

load hoisting means mounted to said boom;

a second self-propelled earthborn mobile unit;

counterweight means mounted on said second self-propelled mobile unit;

a first rigid spreader link having opposite ends thereof connected to the pivotal load platform and to said counterweight means respectively, said first rigid spreader link being extended radially in diametric opposition to said boom with respect to said central vertical axis;

a second rigid spreader link having opposite ends thereof connected to the upper end of said tower and to said counterweight means respectively, said second rigid spreader link overlying said first rigid spreader link in a vertical rigid triangular structure including said tower;

power means mounted to said second self-propelled mobile unit for selectively moving it in a circumferential path about the vertical pivot axis;

and powered winching means operably connected to said load hoisting means.

9. A tower crane as set out in claim 8 wherein the second rigid spreader link and the boom are coaxially mounted to the upper end of said tower about said horizontal pivot axis.

10. A tower crane as set out in claim 8 further comprising:

a stay mast pivotally mounted to the upper end of said tower about a horizontal axis, said stay mast being extended radially outward from the tower in diametric opposition to said boom; and guying means operably connected between said boom, said stay mast, and said counterweight means, whereby the weight of the latter counterbalances loads borne by said load hoisting means.

* * * * *